US006253942B1

(12) United States Patent
Elias

(10) Patent No.: US 6,253,942 B1
(45) Date of Patent: Jul. 3, 2001

(54) EASY OPENING, SCREW CAP FOR THREADED OPENING TYPE CONTAINERS

(76) Inventor: Richard I. Elias, Rio de la Plata 2509-1, Guadalajar, Jalisco 44620 (MX)

( * ) Notice: Subject to any disclaimer, the term of this patent is extended or adjusted under 35 U.S.C. 154(b) by 0 days.

(21) Appl. No.: 09/070,297

(22) Filed: Apr. 30, 1998

(51) Int. Cl.[7] ..... B65D 41/00

(52) U.S. Cl. ..... 215/305; 215/329; 220/212.5; D9/443; D9/451

(58) Field of Search ..... 215/228, 295, 215/305, 329, 334; 220/212.5; D9/443, 451

(56) References Cited

U.S. PATENT DOCUMENTS

| | | | | |
|---|---|---|---|---|
| D. 296,081 | * | 6/1988 | Kuboshima | D9/443 |
| D. 351,793 | * | 10/1994 | Stoller | D9/443 |
| D. 358,329 | * | 5/1995 | Dickie | D9/443 |
| D. 367,613 | * | 3/1996 | Weiler | D9/520 |
| 3,110,411 | * | 11/1963 | Golde | 215/329 |
| 3,433,380 | * | 3/1969 | Kawchitch | 215/329 |
| 3,603,473 | | 9/1971 | Winberg . | |
| 3,675,805 | | 7/1972 | Shane . | |
| 4,003,488 | | 1/1977 | Moller . | |
| 4,090,631 | | 5/1978 | Grussen . | |
| 4,210,251 | | 7/1980 | Grussen . | |
| 4,326,639 | | 4/1982 | Stahl et al. . | |
| 4,333,578 | | 6/1982 | Di Nunzio . | |
| 4,550,843 | | 11/1985 | Nolan . | |
| 4,627,548 | | 12/1986 | Thompson . | |
| 4,731,512 | * | 3/1988 | Barriac | 215/220 |
| 4,782,969 | | 11/1988 | Henning . | |
| 5,265,746 | | 11/1993 | Lee . | |
| 5,381,917 | | 1/1995 | Santagiuliana . | |

* cited by examiner

*Primary Examiner*—Stephen K. Cronin
(74) *Attorney, Agent, or Firm*—John D. Gugliotta

(57) ABSTRACT

An improved, easy opening, screw-cap for threaded opening type containers is disclosed, consisting of a plastic or metal cap of generally cylindrical shape. Located along the upper section of the cap's outer circumferential surface are three, equally spaced, grasping protrusions, that extend radially outward from the radial center of the cap, so as to form a cap of a generally rounded, triangular configuration as seen from above. These grasping protrusions provide torsional, mechanical interference for the hand and it applies rotational force to screw on or off the cap. A series of vertically extending, gripping ribs, are equally spaced along the outer circumferential surface of the upper section of the cap, and are designed to make it easier to screw the cap on and off the neck of a conventional container, such as a bottle. Conventional internal screw threads are used on the internal cavity of the cap to attach the cap to the neck of a conventional container, such as a bottle.

15 Claims, 5 Drawing Sheets

EASY OPENING, SCREW CAP FOR THREADED OPENING TYPE CONTAINERS

BACKGROUND OF THE INVENTION

1. Field of the Invention

The present invention relates generally to container closures, and, more particularly, to an improved, easy opening, screw-cap for bottle-type containers.

2. Description of the Related Art

The problem of providing an easy and efficient opening means for containers such as bottles, has existed for decades. Conventional bottle caps, such as those disclosed in U.S. Pat. No. 4,627,548, issued in the name of Thompson and U.S. Pat. No. 4,550,843, issued in the name of Nolan, require use of a bottle opener to be removed from the bottle. This is inconvenient for most consumers.

U.S. Pat. No. 5,265,746, issued in the name of Lee and U.S. Pat. No. 4,333,578, issued in the name of Di Nunzio, disclose bottle caps having an integral opener. U.S. Pat. No. 4,782,969, issued in the name of Henning, discloses a traditional bottle cap that is designed to be twisted off.

An improvement over traditional bottle caps exists within the art, and is now known as screw-type bottle caps or twist caps. These screw caps generally consist of a cylindrical cap with a series of detendes, or grooves, placed horizontally and equally spaced along the exterior portion of the screw cap. It is these protrusions, or ridges, which the operator uses to open the screw cap. Screw caps haye become an integral part of modern society. They are used on numerous products ranging from bottled soft-drinks and water to medicine and cleaning products.

The problem with conventional screw caps is that there is not enough lateral surface area on the ridges to create mechanical interference with the user's fingers as angular torsion is applied to the ridges relative to the bottle or container to twist off the twist cap. This lack of mechanical interference with the exterior surface of the screw cap necessitates that the operator squeeze the bottle cap to increase friction with the screw cap to assist in the twisting procedure. This method of removal of the screw cap creates several problems.

First, many individuals do not have sufficient hand strength to provide sufficient pressure to the sides of the bottle cap to assist in successful removal of the cap. This is especially true for the young, elderly and infirm, as well as those with arthritis. Second, pressing one's fingers into the ridges to increase the grip causes discomfort. Third, the lack of gripping surfaces for torsional force on the screw cap increases the risk of one's hands slipping from the bottle cap. Fourth, when such slipping occurs, injury to the skin of the fingers is likely, especially when the operator has dry skin. Fifth, difficulty in opening the screw cap increases the jarring motions placed on the bottle or container, which can disrupt the contents, such as with the foam head created by carbonated beverages. All these problems cause difficulty in opening a screw cap as well as inconvenience and frustration to a large segment of the population who use them.

Examples of screw-type caps for containers such as bottle caps in the previous art include U.S. Pat. No. 4,362,639, issued in the name of Stahl, U.S. Pat. No. 4,210,251, issued in the name of Grussen, and U.S. Pat. No. 4,090,631, issued in the name of Grussen.

The '639 device attempts to improve ease of opening by utilizing gripping ribs of slightly larger than normal lateral width. This design, while slightly increasing gripping surface area, does not provide sufficient means to overcome the problems of conventional twist-type caps discussed above, so as to facilitate the opening of twist-type caps in an easy, comfortable manner.

Some devices abandon the screw type configuration. For example, U.S. Pat. No. 3,675,805, issued in the name of Shane, discloses a snap open bottle cap. Similarly, U.S. Pat. No. 4,003,488, issued in the name of Moller, discloses a tear open bottle cap. Devices such as the '805 device and '488 device, however, have not won widespread acceptance by consumers, as is evidenced by their sparse usage.

A search of the prior art did not disclose any patents that read directly on the claims of the instant invention. Consequently, a need has been felt for providing an apparatus and method which overcomes the problems with conventional screw caps cited above.

SUMMARY OF THE INVENTION

It is therefore an object of the present invention to provide an improved, easy opening, screw cap for bottle-type containers that provides a means of creating torsional mechanical interference with the user's hands and a gripping surface on the outer circumferential surface of the screw cap to aid in annular torsion of the screw cap relative to the bottle or container.

It is another object of the present invention to provide for at least one grasping protrusions on the outer circumferential surface of the screw cap which the operator can grasp to aid in removal of the screw cap. The grasping protrusions can be adapted to may shapes, and creates several benefits. First, the squeezing pressure applied to conventional screw caps to open them is reduced. This benefits those individuals who to not have sufficient hand strength to provide sufficient pressure to the sides of the conventional screw cap to assist in successful removal of the cap. Second, the risk of one's hands slipping from the screw cap is reduced. Third, the reduced squeezing pressure reduces finger injury from ridges on the screw cap. Fourth, the jarring motion to the bottle or container associated with difficulties in opening is reduced. This reduces disruption to the contents, such as the foam head created by carbonated beverages or the spilling of contents when the cap suddenly opens. Fifth, inconvenience and frustration to a large segment of the population is reduced.

It is another object of the present invention to provide for increased gripping surface area by disclosing a series of spaced, vertically linear, parallel gripping ribs along the entire exterior, vertical surface of the screw cap.

Briefly described according to one embodiment of the present invention, the present invention consists of a plastic or metal cap of generally cylindrical shape. Located along the upper section of the cap's outer circumferential surface is at least one, but potentially a plurality of spaced, grasping protrusions, that extend radially outward from the radial center of the cap. These grasping protrusions provide torsional, mechanical interference for the hand as it applies rotational force to screw on or off the cap. A series of vertically extending, gripping ribs, are equally spaced along the outer circumferential surface of the upper section of the cap, and are designed to make it easier to screw the cap on and off the neck of a conventional container, such as a bottle. Conventional internal threads are used on the internal cavity of the cap to attach the cap to the neck of a conventional container, such as a bottle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
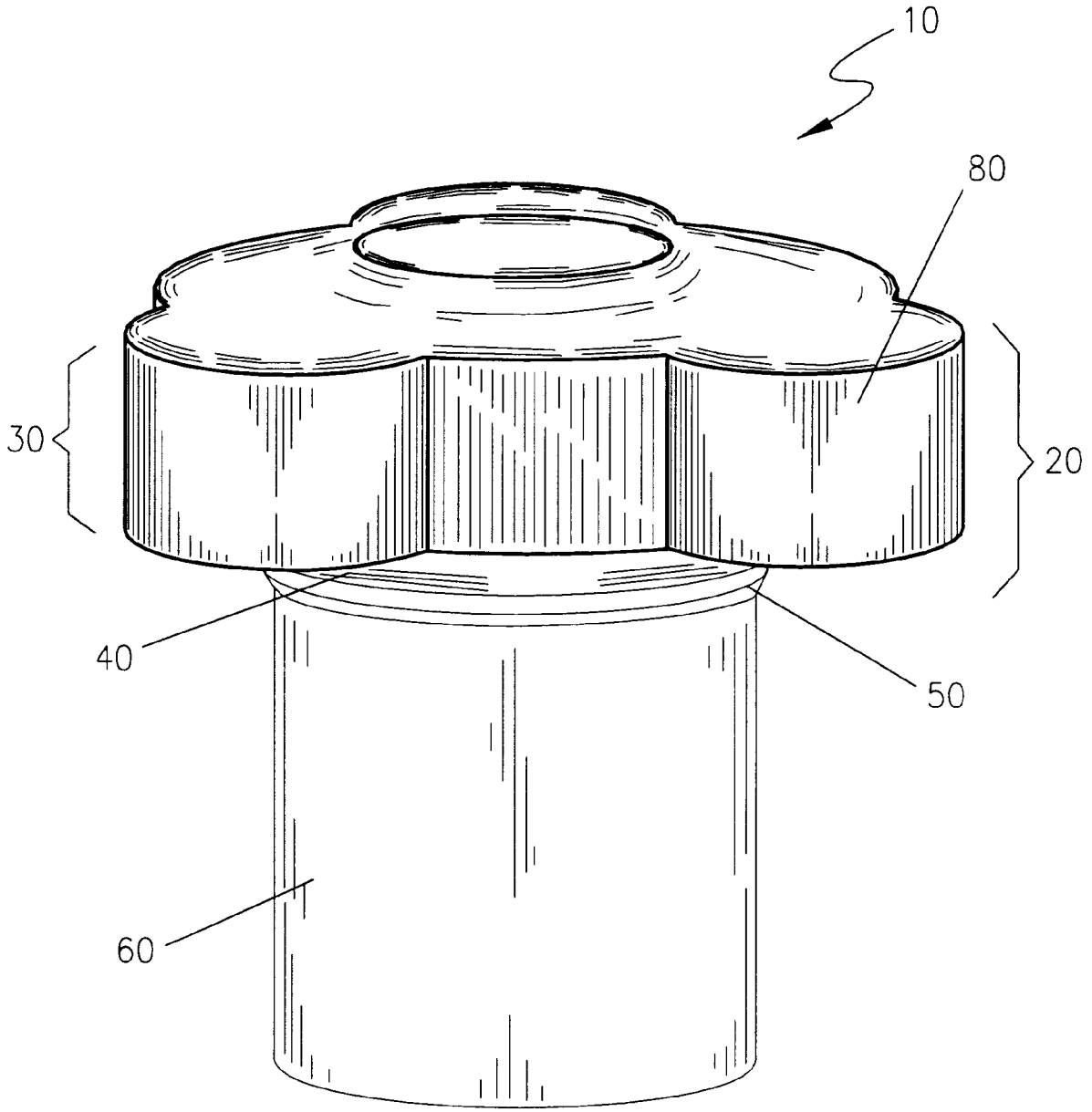
FIG. 1 is a side perspective view of the preferred embodiment of an improved, easy opening, screw-cap for bottle-type containers 10 in use with a conventional container.

10 an improved, easy opening, screw-cap for bottle-type containers
20 cap
30 upper section
40 lower section
50 neck
60 container
70 grasping protrusion
80 gripping rib
90 internal cavity
100 internal screw thread
110 external screw thread

DESCRIPTION OF THE PREFERRED EMBODIMENTS

The best mode for carrying out the invention is presented in terms of its preferred embodiment, herein depicted within the FIGS. 1 through 7.

1. Detailed Description of the Figures

Referring now to FIG. 1, an improved, easy opening, screw-cap for bottle-type containers 10 is shown, according to the present invention, comprising a cap 20 of generally cylindrical configuration and having perimeter protrusions as described below. The cap 20 is made from a strong, lightweight material, such as metal or plastic, and may be of one-piece construction or be comprised of several components.

Figure 2:
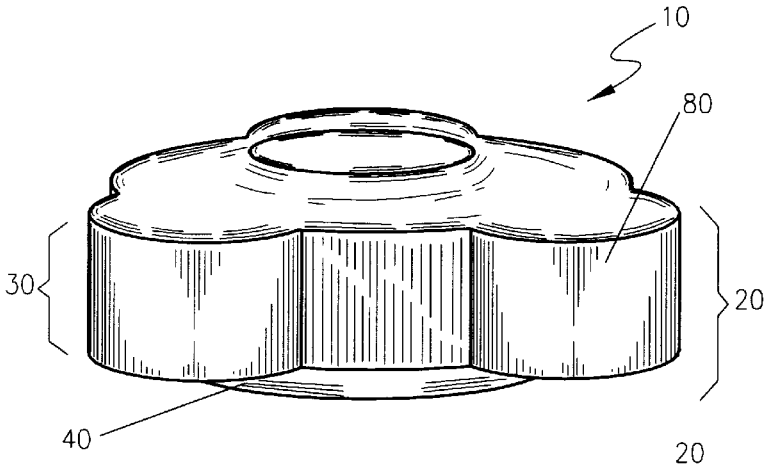
FIG. 2 is a side perspective view of the preferred embodiment of an improved, easy opening, screw-cap for bottle-type containers 10.
Figure 3:
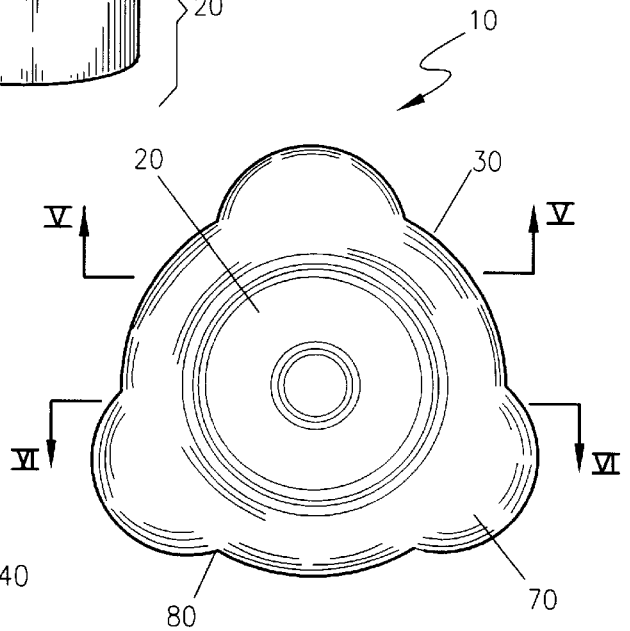
FIG. 3 is a top view thereof.

Referring now to FIGS. 1, 2 & 3, the outer circumferential surface of the cap 20 is divided into an upper section 30 and a lower section. The upper section 30 is of generally cylindrical configuration, with a cross sectional diameter sufficient to permit an individual to easily grasp the outer circumferential surface with the fingers of a hand and apply angular torsion to the cap 20 to twist it on or off of the neck 50 of a conventional container 60, such as a bottle.

Referring now to FIG. 3, the example shows equally spaced along the outer circumferential surface of the upper section 30 is a plurality of grasping protrusion 70, herein disclosing three such grasping protrusions 70. It is envisioned that various configurations and designs may be equally effective. Therefore, the present design shown three equally spaced protrusions is depicted for purposes of clarity ind disclosure only. Each grasping protrusion 70 is formed from the upper section 30, extending vertically along the entire height of the upper section 30. Each grasping protrusion 70 projects horizontally outward from the radial center of the upper section 30 of the cap 20, so as to form a cap 20 of generally rounded, triangular configuration, in the horizontal plane. These grasping protrusions 70 provide torsional, mechanical interference for the fingers of a hand as rotational force is applied to the cap 20 to screw on or off the cap 20.

Formed from the cap 20, and positioned along the outer circumferential surface of the upper section 30 of the cap 20, is a series of vertically extending, gripping ribs 80. The gripping ribs 80 are equally spaced along the outer circumferential surface of the cap 20, and are parallel to each other. The gripping ribs 80 are of conventional design as used in the bottle manufacturing industry. The gripping ribs 80 extend vertically over the entire height of the upper section 30, and are designed to make it easier to screw the cap 20 on and off the neck 50 of a conventional container 60, such as a bottle. The lateral width of each gripping rib is sufficiently small, such that when the fingers of a hand are placed over a plurality of the gripping ribs 80, they provide friction for the fingers as the fingers rotate the cap 20.

Figure 4:
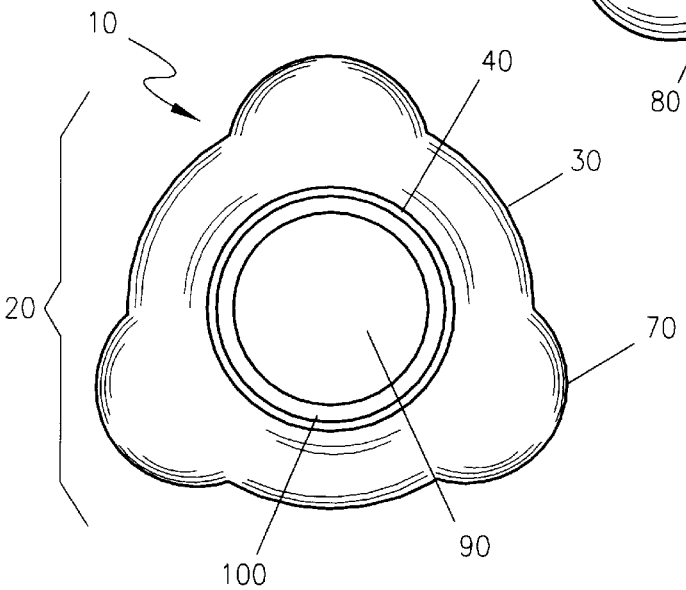
FIG. 4 is a bottom view thereof.

Referring now to FIGS. 2 & 4, the lower section 40 of the cap 20 is positioned below the upper section 30, utilizing the same radial center as the upper section 30. The outer circumferential surface of the lower section 40 is cylindrical in configuration, with a cross sectional diameter less than that of the upper section 30 but greater than that of the neck 50 of a traditional container 60, such as a bottle.

Figure 5:
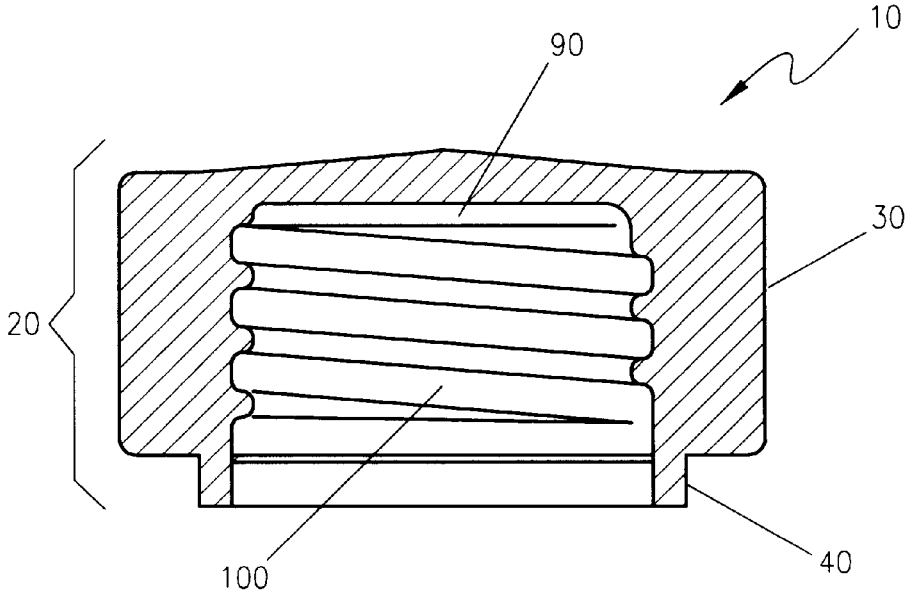
FIG. 5 is a side, cross sectional view thereof, cut along lines V—V.

Referring now to FIG. 5, an internal cavity 90 is formed by the cap 20, with vertical walls also forming the inner circumferential surfaces of the upper section 30 and the lower section 40. The internal cavity 90 has a cylindrical configuration, extending from the bottom of the cap 20, vertically upward, terminating prior to reaching the top of the cap 20. The cross sectional diameter of the internal cavity 90 is of a consistent radial diameter, and the internal cavity 90 is of a sufficient radial diameter such that the neck 50 of a conventional container 60, such as a bottle, can be inserted into the internal cavity 90.

Located along the vertical walls of the internal cavity 90, and molded from the upper section 30 and lower section 40, is an internal screw thread 100.

Figure 6:
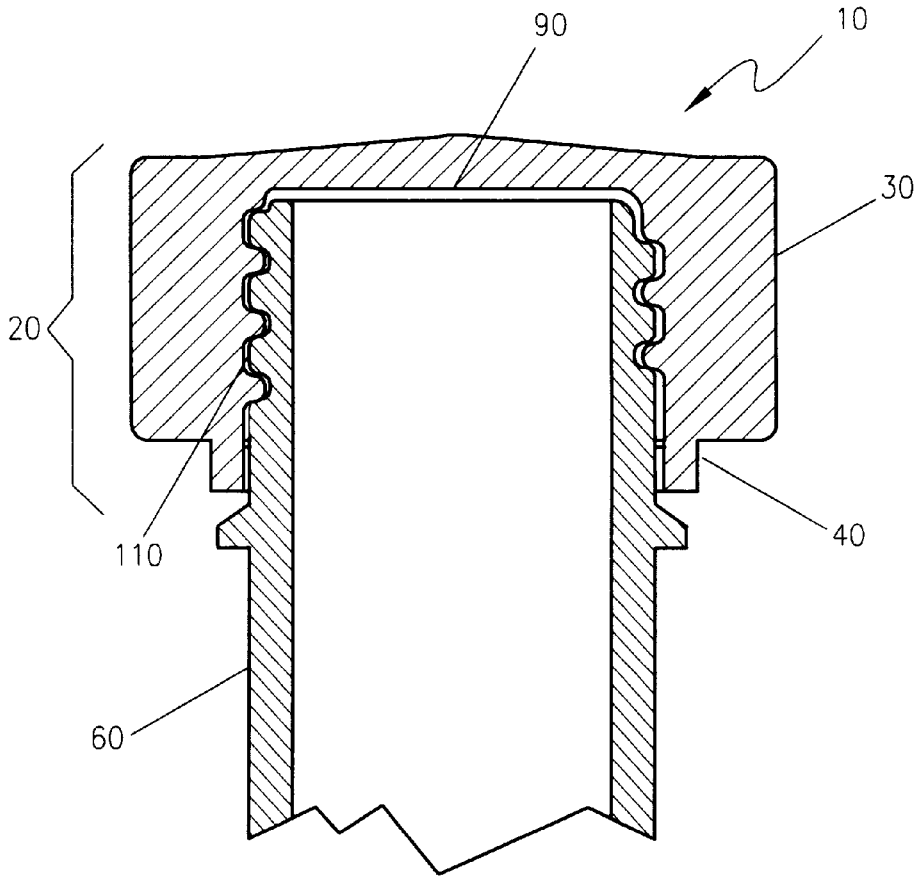
FIG. 6 is a side, cross sectional view thereof in use on the neck of a conventional container, cut along lines VI—VI.

Referring now to FIG. 6, the internal screw thread 100 is of convention design as used in the bottle manufacturing industry, and is designed to mate with the external screw threads 110 located on the exterior surface of the neck 50 of a container 60, such as a bottle. Such mating creates a seal, preventing the escape of liquid or other contents from the container 60.

It is envisioned that other styles of standard, specialty or novel configuration can be easily incorporated into the teachings of the present invention, and only one particular configuration shall be shown and described for purposes of clarity of disclosure and not by way of limitation of scope.

The improved, easy opening, screw-cap for bottle-type containers 10 can be used on different types of containers 60 or bottles with caps 20, including, but not limited to, medicines, soft drinks, nail polishes, and preserves, with the shape and size of the material used varying, depending upon the particular application.

It is also envisioned that in alternate embodiments, the gripping ribs 80 extend radially from the outer circumferential surface of the cap 20 a sufficient distance to facilitate the use of the cap 20 with various containers 60 used by the public, with the radial extension of the gripping ribs 80 depending upon the amount of angular torsion needed to remove the cap 20.

It is further envisioned that in alternate embodiments, the gripping ribs 80 are contoured to the fingers and hand positions of one who uses the cap 20. Furthermore, it is envisioned that in alternate embodiments, the gripping ribs 80 are of varying numbers to facilitate the removal of the cap 20 from various containers 60 used by the public, with the lateral distance between the gripping ribs 80 depending upon the amount of angular torsion needed to remove the cap 20.

Finally, it is envisioned, in alternate embodiments, that the entire outer circumferential surface of the upper section 30 of the cap 20, including the grasping protrusions 70 and gripping ribs 80, will be constructed of a soft, deformable material, such as plastic, so as to facilitate the comfortable gripping and subsequent removal of the cap 20. The deformable material also permits the user to impress his fingers into the outer circumferential surface of the upper section 30, thereby, increasing torsional friction and assisting in the generation of torsional force.

2. Operation of the Preferred Embodiment

Figure 7:
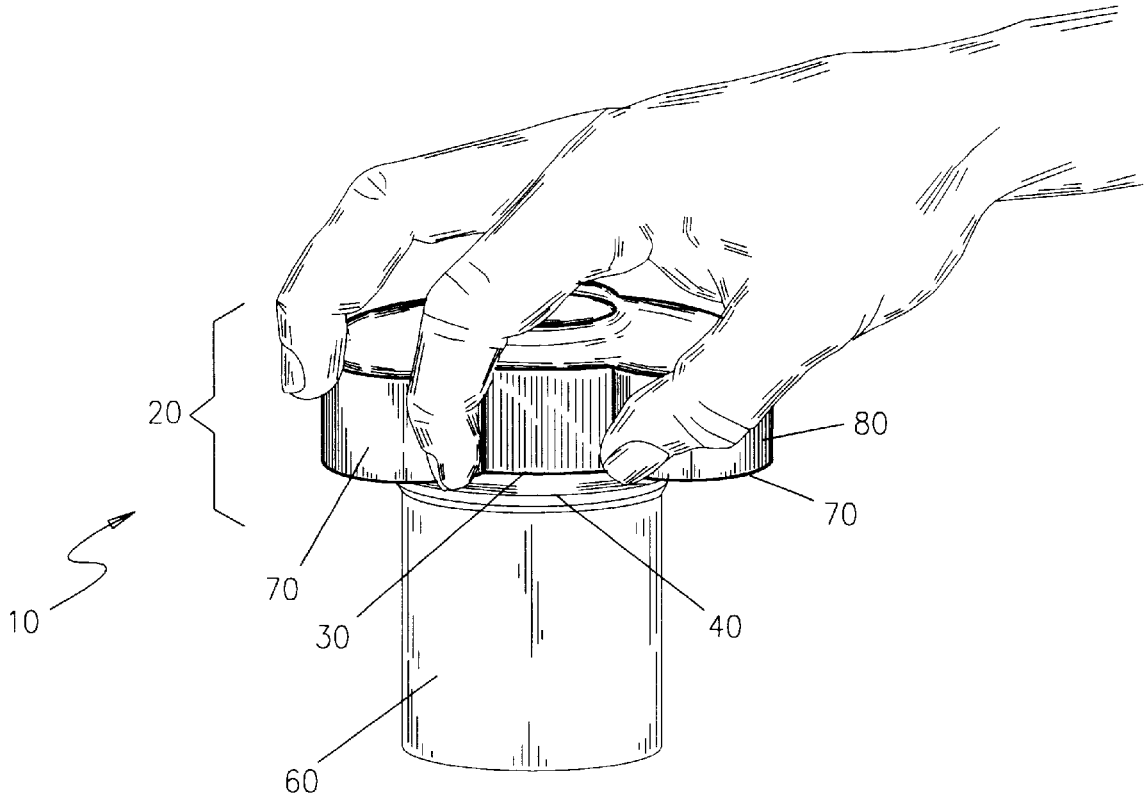
FIG. 7 is side perspective view thereof, being removed from a conventional container.

Referring now to FIG. 7, to use the present invention: first, the operator holds the container 60 in one hand and lifts the cap 20 with the other hand, placing the cap 20 on the neck 50 of a conventional container 60, such as a bottle; second, the operator places his hand around the outer circumferential surface of the upper section 30 of the cap 20 and grasps the cap 20; third, the operator rests his or her fingers against the grasping protrusions 70, creating mechanical interference between the operator's fingers and the grasping protrusions 70; fourth, the operator squeezes his or her fingers around the cap 20 and twists the cap 20, either removing it or replacing it on the neck 50 of the container 60, depending upon his or her desires.

Figure 8A:
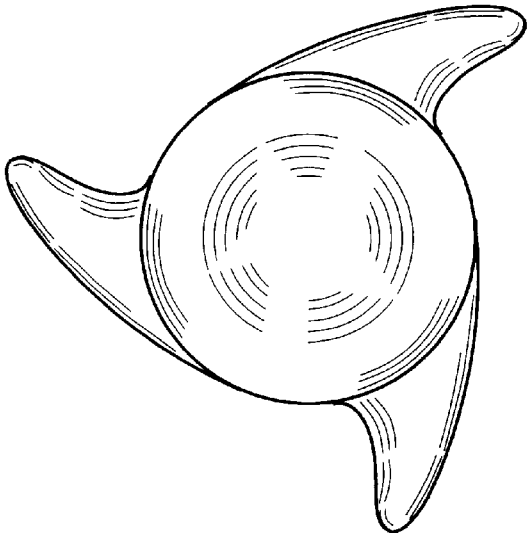
FIG. 8*a*–8*c* are top plan views showing potential alternate embodiments thereof.
Figure 8B:
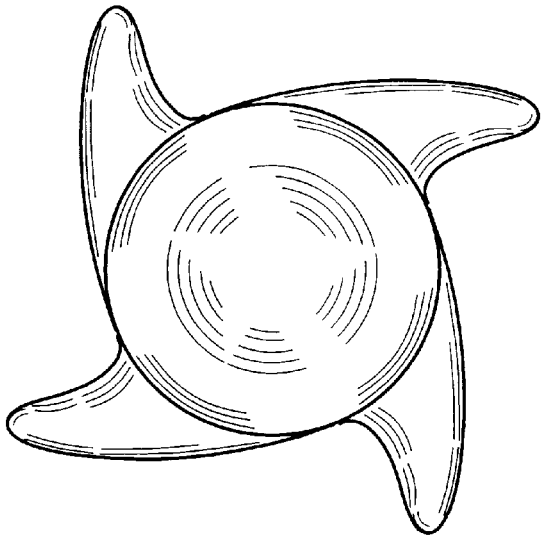
Figure 8C:
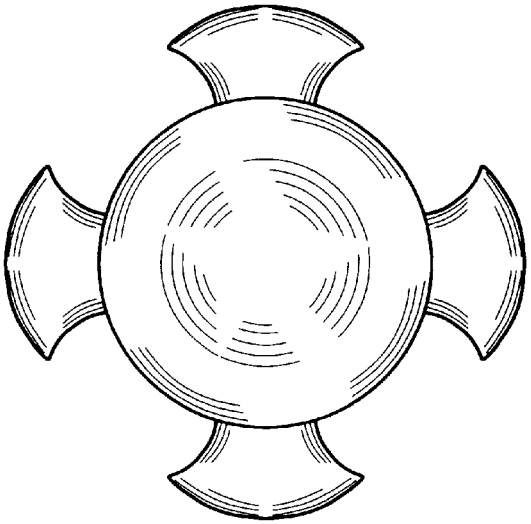

The foregoing description is included to illustrate the operation of the preferred embodiment and is not meant to limit the scope of the invention. It is anticipated that one skilled in the art, in conjunction with the teachings of the present disclosure would be capable of modifying or adapting elements of the present invention in a number of different manners. For purposes of example, and not by way of limitation, FIGS. 8*a*–8*c* indicate just some alternate embodiments, showing asymmetrical grasping protrusions (FIG. 8*a*), directional grasping protrusion (FIG. 8*b*), and bi-directional, symmetric grasping protrusions (FIG. 8*c*). As such, the scope of the invention is to be limited only by the following claims.

What is claimed is:

1. An improved, easy opening, screw-cap for threaded opening type containers comprising:

a cap, of generally cylindrical configuration, with a top, bottom and outer circumferential surface, said outer circumferential surface of said cap being divided into two sections;

an upper section of said cap, said upper section having a radial center, an outer circumferential surface and an inner circumferential surface, said upper surface being of generally cylindrical configuration;

a lower section of said cap, said lower section having a radical center, an outer circumferential surface and an inner circumferential surface, said lower section being positioned below said upper section, said lower section utilizing the same radial center as said upper section, with an outer circumferential surface of said lower section being cylindrical in configuration, with a cross sectional diameter less than that of said upper section but greater than that of a container on which said cap is screwed;

an internal cavity, of cylindrical configuration, said internal cavity being formed by said inner circumferential surface of both said upper section and lower section and said top of said cap, with vertical walls also forming said inner circumferential surfaces of said upper section and said lower section, said internal cavity extending from the bottom of said cap, vertically upward, terminating prior to reaching the top of said cap, with a cross sectional diameter of a consistent radial diameter and of a diameter such that a neck of said container can be inserted into said internal cavity;

internal screw threads, located along the vertical walls of said internal cavity, and formed from said upper section and lower section of said cap, said internal screw thread designed to mate with said external threads located on the exterior surface of said neck of said container;

grasping protrusions, located along said outer circumferential surface of said upper section, said grasping protrusion designed to assist in removal of said cap from said container, wherein each of three grasping protrusion projects horizontally outward from the radial center of said upper section of said cap, so as to form a cap of a generally rounded, triangular configuration in the horizontal plane;

gripping ribs, located along said outer circumferential surface of said upper section and said lower section, said gripping ribs designed to create rotational friction for an operator's hands being used to remove said cap from said container.

2. The improved, easy opening, screw-cap for threaded opening type containers described in claim 1, wherein said upper section has a cross sectional diameter sufficient to permit an individual to easily grasp said outer circumferential surface with the fingers of a hand and apply angular torsion to said cap to twist it on or off of said neck of a conventional container.

3. The improved, easy opening, screw-cap for threaded opening type containers described in claim 1, wherein said grasping protrusion are equally spaced along said outer circumferential surface of said upper section.

4. The improved, easy opening, screw-cap for threaded opening type containers described in claim 1, wherein each said grasping protrusion is formed from said upper section, extending vertically along the entire height of said upper section.

5. The improved, easy opening, screw-cap for threaded opening type containers described in claim 1, wherein said outer circumferential surface of said upper section of said cap, including said grasping protrusions and gripping ribs, will be constructed of a soft, deformable material, such as plastic, so as to facilitate the comfortable gripping and subsequent removal of said cap, said deformable material also permitting the user to impress his fingers into said outer circumferential surface of said upper section, thereby, increasing torsional friction and assisting in the generation of torsional force.

6. The improved, easy opening, screw-cap for threaded opening type containers described in claim 1, wherein said grasping protrusions provide torsional, mechanical interference for the fingers of a hand as rotational force is applied to said cap to screw on or off said cap.

7. The improved easy opening, screw-cap for threaded opening type containers of claim 1, wherein said grasping protrusions are asymmetric about their radial centerline in such a manner as to allow additional torsional grip for left handed or right handed individuals.

8. The improved, easy opening, screw-cap for threaded opening type containers described in claim 1, wherein said gripping ribs are formed from said cap, and positioned equally spaced, along said outer circumferential surface of said upper section of said cap; said gripping ribs extending vertically over the entire height of said upper section, with said gripping ribs being parallel to one another and designed to make it easier to screw said cap on and off said neck of said container, the lateral width of each gripping rib being sufficiently small, such that when the fingers of a hand are placed over a plurality of said gripping ribs, they provide friction for the fingers.

9. The improved, easy opening, screw-cap for threaded opening type containers described in claim 1, wherein said cap is constructed from a strong, lightweight metal or plastic, and may be of one-piece or multi-piece construction.

10. The improved, easy opening, screw-cap for threaded opening type containers described in claim 1, wherein said improved, easy opening, screw-cap for bottle-type containers can be used on different types of containers or bottles with caps, including, but not limited to, medicines, soft drinks, nail polishes, and preserves; with the shape and size of said cap and the material used varying depending upon the particular application.

11. The improved, easy opening, screw-cap for threaded opening type containers described in claim 1, wherein said grasping protrusions extend outward, radially, from said outer circumferential surface of said upper section a sufficient distance to facilitate the removal of said improved, easy opening, screw-cap for bottle-type containers from various containers used by the public, depending upon the amount of angular torsion needed to remove said improved, easy opening, screw-cap for bottle-type containers.

12. The, improved, easy opening, screw-cap for threaded opening type containers described in claim 1, wherein said gripping ribs are of varying numbers to facilitate the removal of said improved, easy opening, screw-cap for bottle-type containers from various containers used by the public depending upon the amount of angular torsion needed to remove said improved, easy opening, screw-cap for bottle-type containers.

13. The improved, easy opening, screw-cap for threaded opening type containers described in claim 1, wherein said gripping ribs and grasping protrusions are contoured to the fingers and hand positions of one who uses the improved, easy opening, screw-cap for bottle-type containers.

14. The improved, easy opening, screw-cap for threaded opening type containers described in claim 1, wherein said configuration of said grasping protrusions create grasping and pressure points for the user's hands to press against while producing angular torsion, thus reducing the chance of said cap from slipping out of a user's hands.

15. The improved, easy opening, screw-cap for threaded opening type containers described in claim 1, wherein said configuration of said grasping protrusions facilitate the application of angular torsion to said cap.

* * * * *